US008425260B2

(12) United States Patent
Seefried et al.

(10) Patent No.: US 8,425,260 B2
(45) Date of Patent: Apr. 23, 2013

(54) HIGH SPEED DATA COMMUNICATIONS CABLE HAVING REDUCED SUSCEPTIBILITY TO MODAL ALIEN CROSSTALK

(75) Inventors: Jeffrey P. Seefried, Lake Stevens, WA (US); Jeffrey Alan Poulsen, Edmonds, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 215 days.

(21) Appl. No.: 12/775,330

(22) Filed: May 6, 2010

(65) Prior Publication Data

US 2011/0275239 A1 Nov. 10, 2011

(51) Int. Cl.
*H01R 24/00* (2006.01)

(52) U.S. Cl.
USPC ..... 439/676; 439/941

(58) Field of Classification Search ..... 439/344, 439/941, 676; 174/113 R
See application file for complete search history.

(56) References Cited

U.S. PATENT DOCUMENTS

| | | | | |
|---|---|---|---|---|
| 3,322,889 | A | 5/1967 | Bird et al. | |
| 5,628,647 | A * | 5/1997 | Rohrbaugh et al. | 439/404 |
| 5,888,100 | A * | 3/1999 | Bofill et al. | 439/676 |
| 5,952,615 | A | 9/1999 | Prudhon | |
| 6,099,345 | A * | 8/2000 | Milner et al. | 439/460 |
| 6,319,069 | B1 * | 11/2001 | Gwiazdowski | 439/676 |
| 6,486,405 | B2 * | 11/2002 | Lin | 174/113 R |
| 6,663,419 | B2 * | 12/2003 | Vaden | 439/502 |
| 7,271,342 | B2 | 9/2007 | Stutzman et al. | |
| 7,332,676 | B2 | 2/2008 | Sparrowhawk | |
| 7,335,837 | B2 | 2/2008 | Pfeiler et al. | |
| 7,550,676 | B2 | 6/2009 | Stutzman et al. | |
| 7,604,515 | B2 * | 10/2009 | Siemon et al. | 439/676 |
| 7,658,648 | B2 * | 2/2010 | Aekins | 439/620.11 |
| 7,736,195 | B1 * | 6/2010 | Poulsen et al. | 439/676 |
| 2002/0017393 | A1 | 2/2002 | Hanna-Myrick | |
| 2006/0162947 | A1 | 7/2006 | Bolouri-Saransar | |
| 2007/0275583 | A1 | 11/2007 | McNutt et al. | |
| 2008/0073106 | A1 | 3/2008 | Brake et al. | |
| 2008/0264670 | A1 | 10/2008 | Glew | |

FOREIGN PATENT DOCUMENTS

JP 2006-260897 9/2006

OTHER PUBLICATIONS

ISR/WO for PCT Application No. PCT/US2011/035387, Dec. 23, 2011.
English translation of patent abstract, JP 2006-260897, Unshielded Twisted Pair Cable with Special-Section Member Interposed, Oki Electric Cable Co. Ltd., Published Sep. 28, 2006.
Augmented Category 6 Cabling Solutions, 10G Plus, Brand-Rex, Product description, 2008, 8 pages, submitted in color.
Brand-Rex Copper Cables—10GPLUS, Product description, published before May 6, 2010, 1 page, submitted in color.
Brand-News Brochure with product descriptions and news, Brand-Rex, Autumn 2006, 6 pages, submitted in color.

* cited by examiner

*Primary Examiner* — Xuong Chung Trans
(74) *Attorney, Agent, or Firm* — Davis Wright Tremaine LLP; George C. Rondeau, Jr.; Heather M. Colburn

(57) ABSTRACT

A communications cable for use with a communications connector having eight contacts arranged in a series. The cable has first, second, third, fourth, fifth, sixth, seventh, and eighth wires configured to be connected to first, second, third, fourth, fifth, sixth, seventh, and eighth contacts, respectively, of the series. The fourth and fifth wires are twisted together to form a first twisted wire pair ("twisted pair"). The first and second wires form a second twisted pair. The third and sixth wires form a third twisted pair. The seventh and eighth wires form a fourth twisted pair. The twisted pairs extend alongside one another and are arranged such that the first twisted pair is closer to the second and third twisted pairs than to the fourth twisted pair, and the second twisted pair is closer to the first and fourth twisted pairs than to the third twisted pair.

22 Claims, 9 Drawing Sheets

HIGH SPEED DATA COMMUNICATIONS CABLE HAVING REDUCED SUSCEPTIBILITY TO MODAL ALIEN CROSSTALK

BACKGROUND OF THE INVENTION

1. Field of the Invention

The present invention is directed generally to communication cables.

2. Description of the Related Art

Conductors that are not physically connected to one another may nonetheless be coupled together electrically and/or magnetically. This coupling creates undesirable signals in adjacent conductors referred to as crosstalk. By placing two elongated conductors (e.g., wires) alongside each other in close proximity (referred to as a "compact pair arrangement"), a common axis can be approximated. The compact pair arrangement is often sufficient to avoid crosstalk if other similar pairs of conductors are in close proximity to the first pair of conductors. Further, if the opposing currents in the conductors are equal, magnetic field "leakage" from the conductors will decrease rapidly as the longitudinal distance along the conductors is increased. If the voltages are also opposite and equal, an electric field primarily concentrated between the conductors will also decrease as the longitudinal distance along the conductors is increased. Twisting the pairs of conductors will tend to negate the residual field couplings and allow closer spacing of adjacent pairs. On the other hand, if for some reason the conductors within a pair are spaced far enough apart, undesired coupling and crosstalk may occur.

"B-Wiring" Format

A conventional communication cable, such as the cable 10 illustrated in cross-section in FIG. 1, includes eight wires W-1 to W-8 substantially identical to one another and arranged to form four twisted-wire pairs P1-P4 (also known as "twisted pairs"). The first twisted pair P1 includes the wires W-4 and W-5. A circle J1 defined by a dashed line illustrates a first region inside the cable 10 that may be occupied by the wires W-4 and W-5 of the first twisted pair P1. The second twisted pair P2 includes the wires W-1 and W-2. A circle J2 defined by a dashed line illustrates a second region inside the cable 10 that may be occupied by the wires W-1 and W-2 of the second twisted pair P2. The third twisted pair P3 includes the wires W-3 and W-6. A circle J3 defined by a dashed line illustrates a third region inside the cable 10 that may be occupied by the wires W-3 and W-6 of the third twisted pair P3. The fourth twisted pair P4 includes the wires W-7 and W-8. A circle J4 defined by a dashed line illustrates a fourth region inside the cable 10 that may be occupied by the wires W-7 and W-8 of the fourth twisted pair P4. The twisted pairs P1-P4 are typically twisted together in a bundle that is often referred to as a quad.

Each of the wires W-1 to W-8 includes an elongated electrical conductor 16 surrounded by an outer insulating layer 18. The electrical conductor 16 may include stranded conductors, a solid conductor (e.g., a conventional copper wire), and the like. The outer insulating layer 18 may be implemented as a conventional insulating flexible plastic jacket.

In accordance with wiring standards, the insulating layer 18 of the wire W-4 of the twisted pair P1 may be solid blue and the insulating layer 18 of the wire W-5 of the twisted pair P1 may be blue and white striped. The color blue has been illustrated in FIGS. 1-6 as horizontal parallel hatch lines. The insulating layer 18 of the wire W-2 of the twisted pair P2 may be solid orange and the insulating layer 18 of the wire W-1 of the twisted pair P2 may be orange and white striped. The color orange has been illustrated in FIGS. 1-6 as diagonal cross-hatched lines. The insulating layer 18 of the wire W-6 of the twisted pair P3 may be solid green and the insulating layer 18 of the wire W-3 of the twisted pair P3 may be green and white striped. The color green has been illustrated in FIGS. 1-6 as diagonal parallel hatch lines that slope downwardly from left to right. The insulating layer 18 of the wire W-8 of the twisted pair P4 may be solid brown and the insulating layer 18 of the wire W-7 of the twisted pair P4 may be brown and white striped. The color brown has been illustrated in FIGS. 1-6 as diagonal parallel hatch lines that slope upwardly from left to right.

The cable 10 may include an outer cable sheath or jacket 12 that surrounds the twisted pairs P1-P4 longitudinally. The jacket 12 is typically constructed from an electrically insulating material. The jacket 12 defines an interior 13 having a central portion 11.

Each of the twisted pairs P1-P4 serves as a differential signaling pair wherein signals are transmitted thereupon and expressed as voltage and current differences between the wires of the twisted pair. Each of the twisted pairs P1-P4 can be susceptible to electromagnetic sources including another nearby cables of similar construction. Signals received by one or more of the twisted pairs P1-P4 from such electromagnetic sources external to the cable's jacket 12 are referred to as "alien crosstalk." Each of the twisted pairs P1-P4 can also receive signals from one or more wires of the three other twisted pairs within the cable's jacket 12, which is referred to as "local crosstalk" or "internal crosstalk."

Inside the prior art cable 10, the twisted pairs P1-P4 are positioned in a predetermined pair lay sequence or order about the central portion 11 of the interior 13 defined by the jacket 12. The predetermined order depicted in FIG. 1 is sometimes referred to as a "B-wiring" format because the arrangement of the twisted pairs P1-P4 is advantageous for terminating the cable 10 to a RJ-45 type plug in accordance with the TIA-568 B wiring format (such as when the cable 10 is used for making patch cables). Thus, the cable 10 is sometimes referred to as a "B-wiring" cable because the predetermined order of the twisted pairs P1-P4 lends itself to termination to an RJ-45 type plug wired to the TIA-568 B wiring format. Alternatively, the cable 10 may be wired to other types of connectors, such as an outlet, a junction block, or the like where positioning of the twisted pairs P1-P4 inside the cable is less critical.

Starting with the first twisted pair P1, in FIG. 1, the twisted pairs P1-P4 are arranged in the following predetermined order clockwise about the central portion 11:

1. the first twisted pair P1;
2. the second twisted pair P2;
3. the third twisted pair P3; and
4. the fourth twisted pair P4.

As is appreciated by those of ordinary skill in the art, each of the twisted pairs P1-P4 has a determined twist length, commonly referred to as a pair lay or pitch. To reduce crosstalk, the pair lays are different for each of the twisted pairs P1-P4. Further, the twisted pairs P1-P4 may be twisted together as a bundle that is typically referred to as a quad.

Optionally, the cable 10 may include a central filler or spline 14 that separates the twisted pairs P1-P4 from one another longitudinally.

"A-Wiring" Format

Occasionally, cable manufactures will produce cables specifically designed to be used for making patch cord that are wired to the TIA-568 A wiring format. A cable 20 illustrated in FIG. 2 is an example of such a cable. For ease of illustration, like reference numerals have been used in FIGS. 1 and 2 to identify like components.

In the cable 20, the position of the second twisted pair P2 in the "B-wiring" format has been switched with the position of the third twisted pair P3 in the "B-wiring" format. Further, in the cable 20, the second twisted pair P2 may be constructed using the pair lay (or pitch) used to construct the third twisted pair P3 in the "B-wiring" format and the third twisted pair P3 may be constructed using the pair lay (or pitch) used to construct the second twisted pair P2 in the "B-wiring" format. Thus, the order of the pair lays inside the cable 20 may remain the same as the order of the pair lays inside the cable 10. Therefore, the cable 20 may be constructed by exchanging the insulation colors of the wires W-3 and W-6 (green and white striped, and solid green, respectively) of the third twisted pair P3 with the insulation colors of the wires W-1 and W-2 (orange and white striped, and solid orange, respectively) of the second twisted pair P2.

Alternatively, different pair lays (or pitches) could be assigned to one or more of the twisted pairs P1-P4 positioned in predetermined order shown in FIG. 2 provided the resulting cable meets desired electrical parameters.

Inside the prior art cable 20, the twisted pairs P1-P4 are positioned in a predetermined pair lay sequence or order about the central portion 11 of the interior 13 defined by the jacket 12. The predetermined order depicted in FIG. 2 is sometimes referred to as an "A-wiring" format because the arrangement of the twisted pairs P1-P4 is advantageous for terminating the cable 10 to a RJ-45 type plug in accordance with the TIA-568 A wiring format (such as when the cable 20 is used for making patch cables). Thus, the cable 20 is sometimes referred to as an "A-wiring" cable because the predetermined order of the twisted pairs P1-P4 lends itself to termination to an RJ-45 type plug wired to the TIA-568 A wiring format. When wired to other types of connectors (such as an outlet, a junction block, and the like) the positioning of the twisted pairs P1-P4 in the cable 20 are less critical. However since this cable is specifically made for patch cables which need to be wired to the TIA-568 A wiring format, it is unlikely that the cable would be used to terminate to other such connectors.

Starting with the first twisted pair P1, the twisted pairs P1-P4 are arranged in the following predetermined order clockwise about the central portion 11:

1. the first twisted pair P1;
2. the third twisted pair P3;
3. the second twisted pair P2; and
4. the fourth twisted pair P4.

Cables having the "A-wiring" format (e.g., the cable 20) are not typically sold to end users. Instead, cables having the "A-wiring" format are generally supplied to assembly houses that produce finished patch cords. Further, a cable having the "B-wiring" format (e.g., the cable 10) is often used to make a patch cord having the "A-wiring" format (e.g., the cable 20). This may be achieved by rearranging the twisted pairs P1-P4 to connect the wires W-1 to W-8 to contacts positioned inside a plug in accordance with the TIA-568 A wiring format. The "B-wiring" format is by far the most prevalent wiring format used in structured cabling systems.

Plugs Wired According to TIA-568 B

Referring to FIG. 3, as mentioned above, the wires W-1 to W-8 of the twisted pairs P1-P4, may be physically connected to a plug 30. For ease of illustration, the plug 30 is illustrated as a RJ-45 type-plug wired according to TIA-568 B wiring format. The plug 30 includes a plurality of conductors or contacts P-T1 to P-T8 arranged in a series. The plug 30 has a housing 34 with a rearward facing open portion 36 opposite the contacts P-T1 to P-T8. The twisted pairs P1-P4 of the cable 10 (see FIG. 1) are received inside the plug 30 through the rearward facing open portion 36 and physically connected to the contacts P-T1 to P-T8.

The contacts P-T1 to P-T8 of the plug 30 are each connected to a different wire (W-1 to W-8) of the four twisted pairs P1-P4. The wires W-1 to W-8 of the twisted pairs P1-P4 are connected to the plug contacts P-T1 to P-T8, respectively. The twisted pair P1 (i.e., the wires W-4 and W-5) is connected to the adjacent plug contacts P-T4 and P-T5 to form a first differential signaling pair. The twisted pair P2 (i.e., the wires W-1 and W-2) is connected to the adjacent plug contacts P-T1 and P-T2 to form a second differential signaling pair. The twisted pair P3 (i.e., the wires W-3 and W-6) is connected to the troublesome "split" plug contacts P-T3 and P-T6 to form a "split" third differential signaling pair. The twisted pair P4 (i.e., the wires W-7 and W-8) is connected to the adjacent plug contacts P-T7 and P-T8 to form a fourth differential signaling pair. The plug contacts P-T3 and P-T6 flank the plug contacts P-T4 and P-T5. The second and fourth differential signaling pairs are located furthest apart from one another and the first and third differential signaling pairs are positioned between the second and fourth differential signaling pairs.

The plug 30 is configured to be received inside a jack or outlet (not shown) having a plurality of outlet contacts arranged in a series. The plug 30 and the outlet are each types of communication connectors. The outlet includes a different outlet contact for each of the plug contacts P-T1 to P-T8. When the plug 30 is received inside the outlet, each of the plug contacts P-T1 to P-T8 forms an electrical connection with a corresponding one of the outlet contacts. When connected together to form these electrical connections, the plug 30 and outlet form a communication connection.

Plugs Wired According to TIA-568 A

Referring to FIG. 4, alternatively, the twisted pairs P1-P4, may be physically connected to a plug 40. For ease of illustration, the plug 40 is illustrated as a RJ-45 type-plug wired according to TIA-568 A wiring format. Further, like reference numerals have been used to identify like components in FIGS. 3 and 4. The twisted pairs P1-P4 of the cable 20 (see FIG. 2) are received inside the plug 40 through the rearward facing open portion 36 and physically connected to the contacts P-T1 to P-T8. However, as explained above, the twisted pairs P1-P4 of the cable 10 (see FIG. 1) may be terminated at the plug 40.

Inside the plug 40, the twisted pair P1 (i.e., the wires W-4 and W-5) is connected to the adjacent plug contacts P-T4 and P-T5 to form a first differential signaling pair. The twisted pair P3 (i.e., the wires W-3 and W-6) is connected to the adjacent plug contacts P-T1 and P-T2 to form a second differential signaling pair. The twisted pair P2 (i.e., the wires W-1 and W-2) is connected to the troublesome "split" plug contacts P-T3 and P-T6 to form a "split" third differential signaling pair. The twisted pair P4 (i.e., the wires W-7 and W-8) is connected to the adjacent plug contacts P-T7 and P-T8 to form a fourth differential signaling pair. The second and fourth differential signaling pairs are located furthest apart from one another and the first and third differential signaling pairs are positioned between the second and fourth differential signaling pairs.

The plug 40 is configured to be received inside a jack or outlet (not shown) having a plurality of outlet contacts arranged in a series. The outlet includes a different outlet contact for each of the plug contacts P-T1 to P-T8.

When the plug 40 is received inside the outlet, each of the plug contacts P-T1 to P-T8 forms an electrical connection with a corresponding one of the outlet contacts. When connected together to form these electrical connections, the plug 40 and outlet form a communication connection.

Common Mode Noise

Referring to FIGS. 3 and 4, independent of which wiring format is used, the twisted pair P4 is connected to the plug contacts P-T7 and P-T8 and the twisted pair P1 is connected to the plug contacts P-T4 and P-T5. Further, the wires of one of the twisted pairs (i.e., the twisted pair P2 or the twisted pair P3) are split to flank the twisted pair P1. Thus, with respect the plugs 30 and 40, the cables 10 and 20 may be described as including a first outside twisted pair (i.e., the twisted pair P4), a second outside twisted pair (i.e., the twisted pair P2 in the cable 10 or the twisted pair P3 in the cable 20), a split twisted pair (i.e., the twisted pair P3 in the cable 10 or the twisted pair P2 in the cable 20), and a flanked twisted pair (i.e., the twisted pair P1).

As is appreciated by those of ordinary skill in the art, typical Augmented Category 6 RJ-45 type hardware can cause a considerable amount of undesirable common mode signal that presents itself most noticeably on the twisted pair P1 associated with the plug contacts P-T1 and P-T2, and the twisted pair P4 associated with the plug contacts P-T7 and P-T8. The plug-outlet interface is typically the origin of undesired mode conversion coupling in a communication connection. At this location, the wires of the split twisted pair, the plug contacts P-T3 and P-T6, and the outlet contacts connected to the plug contacts P-T3 and P-T6, are spaced apart from one another, and may couple (capacitively and/or inductively) with the other conductors of the communication connection.

A challenge of the structural requisites of conventional communication cabling standards relates to the fact that the wires of the split twisted pair are connected to widely spaced plug contacts P-T3 and P-T6, respectively, which straddle the plug contacts P-T4 and P-T5 to which the wires of the flanked twisted pair are connected. This arrangement of the plug contacts P-T1 and P-T8 and their associated wiring can cause a signal transmitted on the split twisted pair to impart different voltages and/or currents onto the first and second outside twisted pairs effectively causing differential voltages between a composite of both wires of the first outside twisted pair, and a composite of both wires of the second outside twisted pair. These differential voltages are the result of an undesired coupling referred to hereafter as a "modal launch" or "mode conversion," that unfortunately may enhance alien crosstalk elsewhere in a system.

The undesirable common mode signals traveling on the plug tines P-T1 and P-T2 are approximately equal in magnitude but opposite in direction to the undesirable common mode signals traveling on the plug tines P-T7 and P-T8. They travel down the length of the cable looking for a path to ground. Taken together these two signals can be viewed as a differential-mode signal propagating along a "quasi pair" of conductors. The first "wire" of the "quasi pair" includes conductors connected to the plug tines P-T1 and P-T2, acting together as a single first conductor. The second "wire" of the "quasi pair" includes conductors connected to the plug tines P-T7 and P-T8, acting together as a single second conductor.

In other words, the wires of the first outside twisted pair behave as a first two-stranded or "composite" wire and the wires of the second outside twisted pair behave as a second two-stranded or "composite" wire. As a result, a small "coupled" portion of the differential signal originating on the split twisted pair appears as two opposite common, or "even," mode signals on the first and second "composite" wires. Unfortunately, the wider spacing of the first and second "composite" wires enhances vulnerability and sourcing of unwanted crosstalk in other nearby cables, such as cables in the same bundle or conduit.

In both the "A-wiring" and "B-wiring" formats, the composite conductors of the "quasi pair" includes wires that are spaced apart from one another diagonally across of the central portion 11 of the interior 13 of the cable. In other words, the first outside twisted pair (i.e., the first composite conductor) is spaced apart diagonally from the second outside twisted pair (i.e., the second composite conductor) across of the central portion 11 of the interior 13 of the cable. In embodiments that include the spline 14, this distance may be further increased by the spline 14 interposed between the twisted pairs P1-P4. Because of the rather large distance between the first and second composite conductors and the relatively uncontrolled geometry of the core, (compared to the tightly controlled geometry of each of the twisted pairs P1-P4), energy is easily radiated from the "quasi pair." This energy or signal may differentially couple with similarly constructed "quasi pairs" in surrounding cables to create alien crosstalk.

Therefore, a need exists for cables that radiate and/or conduct less crosstalk. In particular, a cable configured to radiate and/or conduct less alien crosstalk resulting from the modal conversion discussed above is desirable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 5:
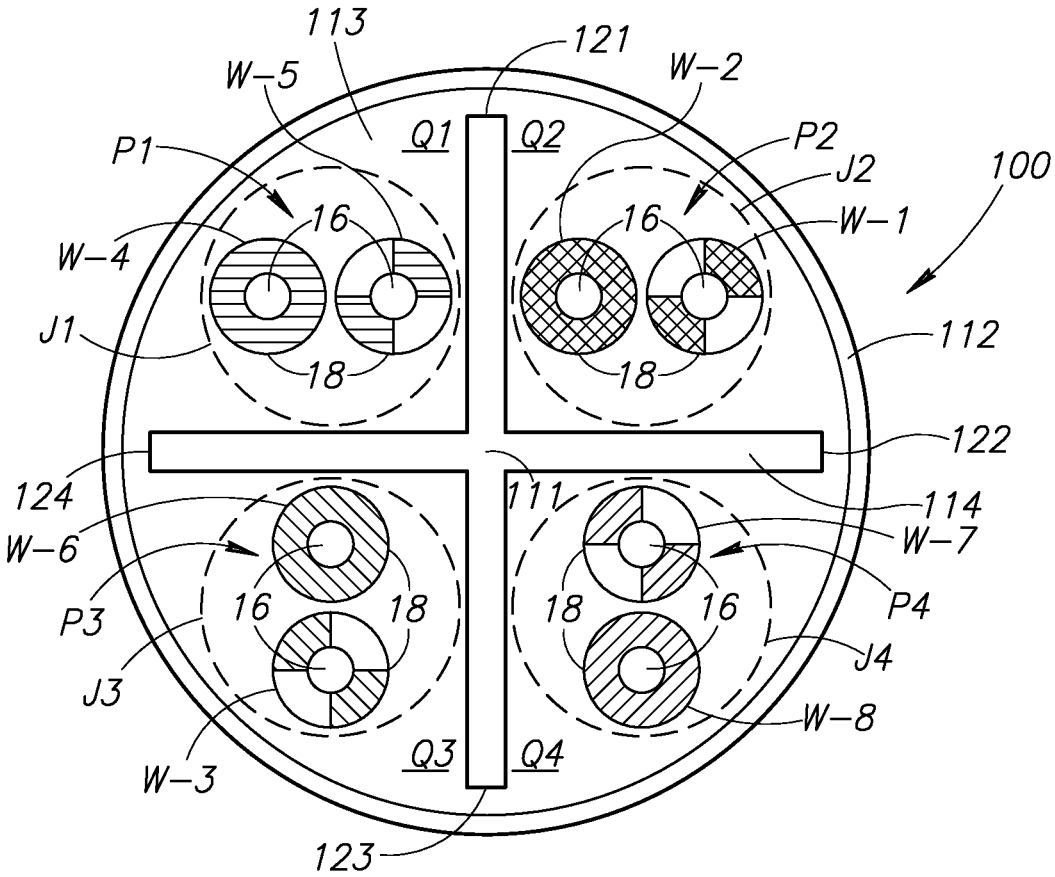
FIG. 5 is a lateral cross-section of a communication cable constructed in accordance with the present invention.

FIG. 5 illustrates a cross-section of a cable 100. The cable 100 includes the eight wires W-1 to W-8, which are substantially identical to one another and arranged to form the four twisted pairs P1-P4. The first twisted pair P1 includes the wires W-4 and W-5. A circle J1 defined by a dashed line illustrates a first region inside the cable 100 that may be occupied by the wires W-4 and W-5 of the first twisted pair P1. The second twisted pair P2 includes the wires W-1 and W-2. A circle J2 defined by a dashed line illustrates a second region inside the cable 100 that may be occupied by the wires W-1 and W-2 of the second twisted pair P2. The third twisted pair P3 includes the wires W-3 and W-6. A circle J3 defined by a dashed line illustrates a third region inside the cable 100 that may be occupied by the wires W-3 and W-6 of the third twisted pair P3. The fourth twisted pair P4 includes the wires W-7 and W-8. A circle J4 defined by a dashed line illustrates a fourth region inside the cable 100 that may be occupied by the wires W-7 and W-8 of the fourth twisted pair P4. The twisted pairs P1-P4 are typically twisted together in a bundle that is typically referred to as a quad.

Each of the wires W-1 to W-8 includes the elongated electrical conductor 16 surrounded by the outer insulating layer 18. The electrical conductor 16 may include stranded conductors, a solid conductor (e.g., a conventional copper wire), and the like. The outer insulating layer 18 may be implemented as a conventional insulating flexible plastic jacket.

The cable 100 may include an outer cable sheath or jacket 112 that surrounds the twisted pairs P1-P4 longitudinally. Thus, the twisted pairs P1-P4 are housed inside the jacket 112, which may be constructed from an electrically insulating material. The jacket 112 defines an interior 113 having a central portion 111.

Each of the twisted pairs P1-P4 serves as a differential signaling pair wherein signals are transmitted thereupon and expressed as voltage and current differences between the wires of the twisted pair. Inside the cable 100, the twisted pairs P1-P4 are positioned in a predetermined order about the substantially centrally located central portion 111. The predetermined order of the twisted pairs P1-P4 inside the cable 100 is different from the "A-wiring" and "B-wiring" formats in one substantial way; inside the cable 100, the first twisted pair P1 is positioned diagonally across the central portion 111 of the interior 113 of the cable 100 from the fourth twisted pair P4. Thus, the second twisted pair P2 is positioned diagonally across the central portion 111 from the third twisted pair P3. Starting with the first twisted pair P1, in FIG. 1, the twisted pairs P1-P4 are arranged in the following predetermined order clockwise about the central portion 111:

1. the first twisted pair P1;
2. the second twisted pair P2;
3. the fourth twisted pair P4; and
4. the third twisted pair P3.

In this predetermined order, the fourth twisted pair P4 is adjacent the third twisted pair P3. Further, the fourth twisted pair P4 is also adjacent the second twisted pair P2. The fourth twisted pair P4 is closer to the third twisted pair P3 and the second twisted pair P2 than the fourth twisted pair P4 is to the first twisted pair P1. Also, the third twisted pair P3 is closer to the first twisted pair P1 and the fourth twisted pair P4 than the third twisted pair P3 is to the second twisted pair P2. When connected to the plug contacts P-T1 to P-T8 of the plug 30 illustrated in FIG. 3, the twisted pair P4 and the twisted pair P2 form a "quasi pair."

As is appreciated by those of ordinary skill in the art, each of the twisted pairs P1-P4 has a determined twist length, commonly referred to as a pair lay or pitch. To reduce crosstalk, the pair lays are different for each of the twisted pairs P1-P4. As mentioned above, the twisted pairs P1-P4 may be twisted together as a bundle (not shown). The twist length of the bundle is referred as a cable lay or cable lay length.

To avoid adversely affecting the normal electrical characteristics of the cable, the fourth twisted pair P4 may be constructed using the pair lay used for the third twisted pair P3 in the "B-wiring" format and the third twisted pair P3 may be constructed using the pair lay used for the fourth twisted pair P4 in the "B-wiring" format. Thus, the predetermined order depicted in FIG. 5 may be characterized as interchanging the colors of the insulating layers 18 of wires W-3 and W-6 of the third twisted pair P3 in the "B-wiring" format illustrated in FIG. 1 with the colors of the insulating layers 18 of wires W-7 and W-8 of the fourth twisted pair P4 of the cable 10 in the "B-wiring" format illustrated in FIG. 1.

Alternatively, different pair lays (or pitches) configured to meet desired electrical parameters may be assigned to one or more of the twisted pairs P1-P4 positioned in predetermined order shown in FIG. 5.

Optionally, the cable 100 may include a central filler or spline 114 having dividing walls 121-124 that maintain separation between the twisted pairs P1-P4 along the entire length of the cable. The spline 114 may be made from a non-condive material such as polyethelyn or Fluorinated ethylene propylene (FEP). The dividing walls 121-124 divide the inside of the cable 100 into longitudinally extending quadrants Q1-Q4 as shown in FIG. 5.

In the embodiment illustrated, the first dividing wall 121 separates the first quadrant Q1 from the second quadrant Q2. The first twisted pair P1 is positioned inside the first quadrant Q1 and the second twisted pair P2 is positioned inside the second quadrant Q2. Thus, the first dividing wall 121 separates the first twisted pair P1 from the second twisted pair P2. The second dividing wall 122 separates the second quadrant Q2 from the third quadrant Q3. The fourth twisted pair P4 is positioned inside the third quadrant Q3. Thus, the second dividing wall 122 separates the second twisted pair P2 from the fourth twisted pair P4. The third dividing wall 123 separates the third quadrant Q3 from the fourth quadrant Q4. The third twisted pair P3 is positioned inside the fourth quadrant Q4. Thus, the third dividing wall 123 separates the fourth twisted pair P4 from the third twisted pair P3. The fourth dividing wall 124 separates the fourth quadrant Q4 from the first quadrant Q1. Thus, the fourth dividing wall 124 separates the third twisted pair P3 from the first twisted pair P1.

Figure 1:
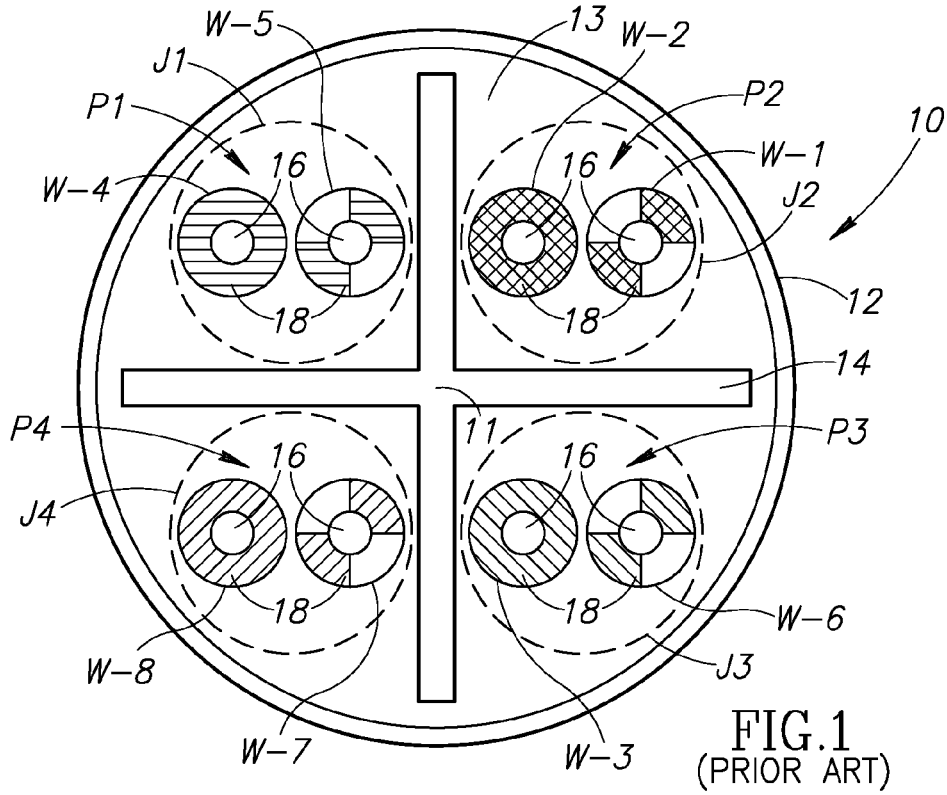
FIG.1 (PRIOR ART)
FIG. 1 is a lateral cross-section of a conventional communication cable constructed according to TIA-568 B wiring format.

Unlike in the prior art cable 10 illustrated in FIG. 1 (where the fourth twisted pair P4 is positioned diagonally across the central portion 11 of the interior 13 of the cable 10 from second twisted pair P2), inside the cable 100 illustrated in FIG. 5, the fourth twisted pair P4 is directly adjacent to the second twisted pair P2. When the cable 100 is connected to hardware using the TIA-568 B wiring format, the twisted pair P4 and the twisted pair P2 form a "quasi pair" that may carry a significant amount of common mode signals that can result in alien crosstalk. By positioning twisted pairs P2 and P4 directly adjacent to one another other, the cable 100, has certain electrical advantages over the prior art cable 10 (see FIG. 1) in which the twisted pairs P2 and P4 are positioned diagonally across the central portion 11 from one another.

The "quasi pair" of the cable 100 illustrated in FIG. 5 (which is formed by the adjacent twisted pairs P2 and P4) has a lower impedance than the "quasi pair" of the cable 10 illustrated in FIG. 1 (which is formed by the diagonally arranged twisted pairs P2 and P4). This lower impedance reduces the amplitude of the common mode signals that can be induced onto the "quasi pair" by other nearby conductors.

Depending upon the implementation details, the "quasi pair" of the cable 100 (which is formed by the adjacent twisted pairs P2 and P4) may be more mechanically more stable than the "quasi pair" of the cable 10 illustrated in FIG. 1 (which is formed by the diagonally arranged twisted pairs P2 and P4). In embodiments that include the spline 114, this stability may result from the geometric configuration of spline 114, which positions the adjacent twisted pairs P2 and P4 of the cable 100 in closer physical proximity to one another than the diagonally arranged twisted pairs P2 and P4 of the cable 10. When the twisted pairs P2 and P4 of the "quasi pair" are positioned diagonally across the central portion 11 of the interior 13 as in the prior art cable 10, mechanical factors can reduce the mechanical stability of the twisted pairs P2 and P4. This mechanical instability causes a corresponding electrical instability that can, in turn, cause the "quasi pair" to be more susceptible to unwanted signals from other nearby conductors. Likewise, the mechanical instability can also make the "quasi pair" more likely to radiate electrical signals to other nearby conductors thereby causing additional crosstalk.

Similarly, returning to FIG. 5, inside the cable 100, the fourth twisted pair P4 is also adjacent to the third twisted pair P3. When the cable 100 is connected to hardware using the TIA-568 A wiring format, the third twisted pair P3 and the fourth twisted pair P4 form a "quasi pair" that may carry a significant amount of common mode signals that can result in alien crosstalk. By positioning twisted pairs P3 and P4 directly adjacent to one another other, the cable 100, has certain electrical advantages over the prior art cable 20 (see FIG. 2) in which the twisted pairs P3 and P4 are positioned diagonally across the central portion 11 from one another. These electrical advances are substantially similar to the electrical advances discussed above with respect to twisted pairs P2 and P4 when the cable 100 is connected to hardware using the TIA-568 B wiring format.

Figure 2:
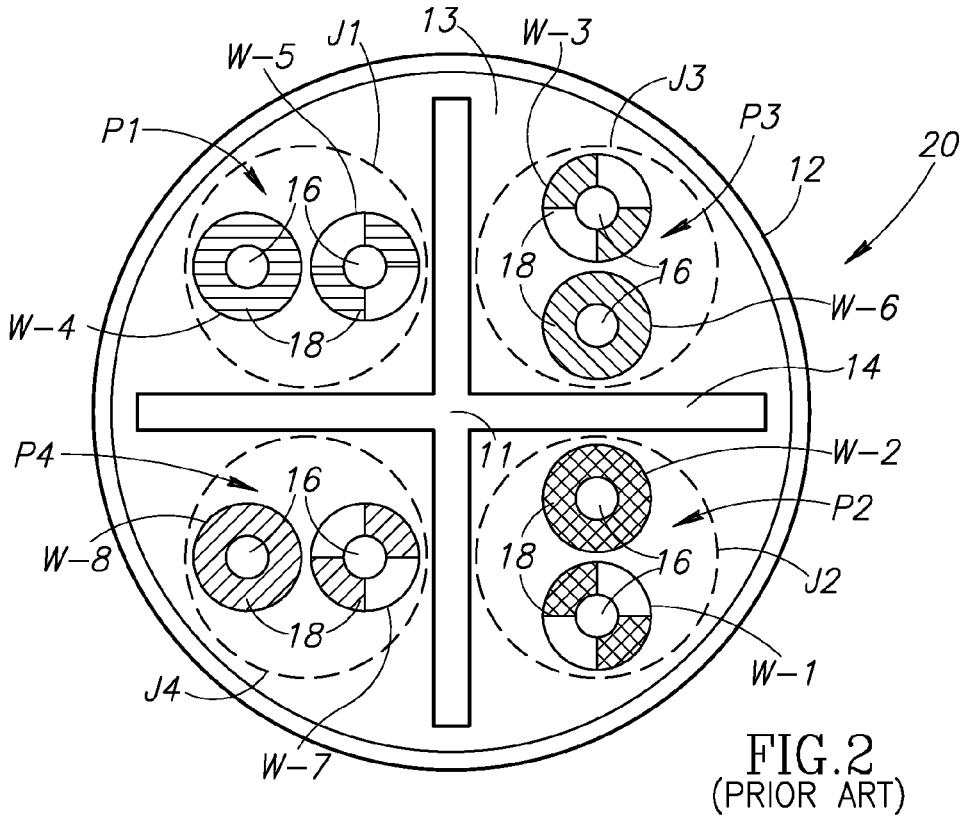
FIG.2 (PRIOR ART)
FIG. 2 is a lateral cross-section of a conventional communication cable constructed according to TIA-568 A wiring format.

For example, referring to FIG. 5, depending upon the implementation details, the "quasi pair" of the cable 100 formed by the adjacent twisted pairs P3 and P4 may have lower impedance than the "quasi pair" of the cable 20 formed by the diagonally arranged twisted pairs P3 and P4 and illustrated in FIG. 2. This lower impedance reduces the amplitude of the common mode signals that can be induced onto the "quasi pair" by other nearby conductors.

By way of another non-limiting example, and depending upon the implementation details, the "quasi pair" of the cable 100 formed by the adjacent twisted pairs P3 and P4 may be more mechanically more stable than the "quasi pair" of the cable 20 formed by the diagonally arranged twisted pairs P3 and P4 and illustrated in FIG. 2. In embodiments that include the spline 114, this stability may result from the geometric configuration of spline 114, which positions the adjacent twisted pairs P3 and P4 of the cable 100 in closer physical proximity to one another than the diagonally arranged twisted pairs P3 and P4 of the cable 20. When the twisted pairs P3 and P4 of the "quasi pair" are positioned diagonally across the central portion 11 of the interior 13 as in the prior art cable 20, mechanical factors can reduce the mechanical stability of the twisted pairs P3 and P4. This mechanical instability causes a corresponding electrical instability that can, in turn, cause the "quasi pair" to be more susceptible to unwanted signals from other nearby conductors. Likewise, the mechanical instability can also make the "quasi pair" more likely to radiate electrical signals to other nearby conductors thereby causing additional crosstalk.

As explained above, depending upon whether the cable 100 is connected to hardware using the TIA-568 B wiring format or the TIA-568 A wiring format, the "quasi pair" may include either the twisted pairs P2 and P4 or the twisted pairs P3 and P4. It is believed the wiring configuration of the cable 100 causes these "quasi pairs" to emit and/or receive less electromagnetic energy than is emitted and/or received by the "quasi pairs" formed in the conventional cables 10 and 20 (illustrated in FIGS. 1 and 2, respectively), when the cable 100 is employed in wiring applications using the "A-wiring" format and/or the "B-wiring" format.

It is further believed this reduction in the emission and/or reception of electromagnetic energy, as well as, the unique way in which the "quasi pairs" in nearby cables constructed in accordance with the cable 100 mechanically and electrically interact with one another, reduce the amount of alien crosstalk conveyed between the "quasi pairs" of such nearby cables compared with the amount of alien crosstalk conveyed between nearby cables constructed according to the cable 10 (see FIG. 1) and/or the cable 20 (see FIG. 2).

From a manufacturing point of view, the cable 100 illustrated in FIG. 5 may be constructed using the same processes and equipment used to construct the cable 10 illustrated in FIG. 1. The dimensions inside the cable 100 may be substantially identical to the dimensions inside the cable 10. Further, the sequence of pair lays in the cable 100 may be the same as the sequence of pair lays in the cable 10. To manufacture the cable 100, only the color of the insulating layers 18 applied to the electrical conductors 16 of the twisted pairs P3 and P4 need be swapped so that the twisted pairs P1-P4 are arranged in the predetermined order depicted in FIG. 5.

As mentioned above, alternatively, different pair lays (or pitches) configured to meet desired electrical parameters may be assigned to one or more of the twisted pairs P1-P4 positioned in predetermined order shown in FIG. 5.

Because only the color of the insulating layers 18 of the twisted pairs P3 and P4 changes, certain aspects of the performance of the cable 100 do not change from that of the original prior art cable 10. However, the transmission data from the cable 100 depicted in FIG. 5 would be re-assigned to reflect the change of color of the color of the insulating layers 18 of the twisted pairs P3 and P4. For example, return loss corresponding to the twisted pair P3 in the cable 10 illustrated in FIG. 1, corresponds to the return loss of the twisted pair P4 in the cable 100 illustrated in FIG. 5. Similarly, the NEXT for twisted pairs P1 and P3 in the cable 10 corresponds to NEXT for twisted pairs P1 and P4 in the cable 100 illustrated in FIG. 5.

Reduced coupling between the "quasi pairs" in nearby cables reduces an amount of modal alien crosstalk between those nearby cables, which reduces a total amount of alien crosstalk occurring between the nearby cables. Inside a communications system (not shown) including conventional RJ-45 type hardware, the reduced coupling between the "quasi pairs" in nearby cables constructed in accordance with the cable 100 reduces a total amount of alien crosstalk occurring inside the system (compared to a total amount of alien crosstalk occurring inside a system including only conventional cables). These reductions in the total amount of alien crosstalk occurring between the nearby cables, and the total amount of alien crosstalk occurring inside a system, have been demonstrated in simulations as well as in actual empirical experiments designed to measure alien crosstalk.

Simulation Results

Figure 6:
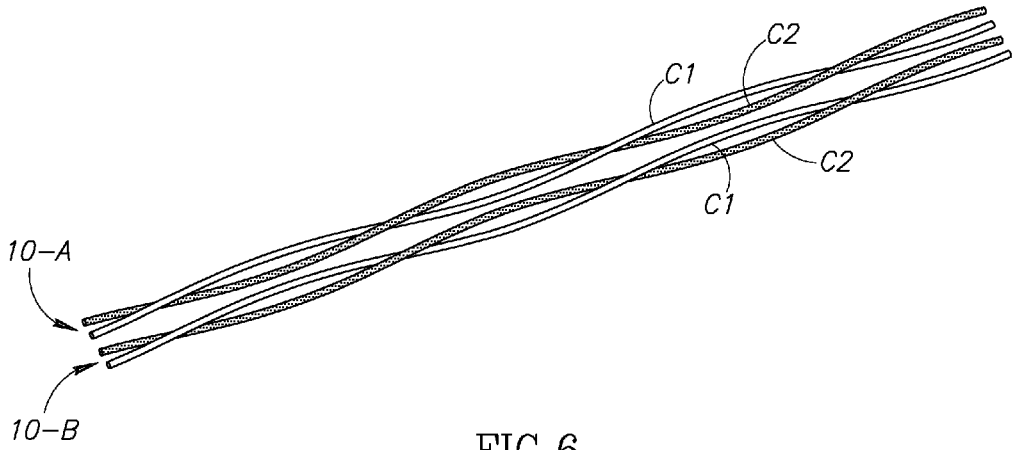
FIG. 6 is a perspective view of a model of a "quasi-pair" of a first conventional cable constructed according to TIA-568 B wiring format and a "quasi-pair" of a second conventional cable constructed according to TIA-568 B wiring format.
Figure 7:
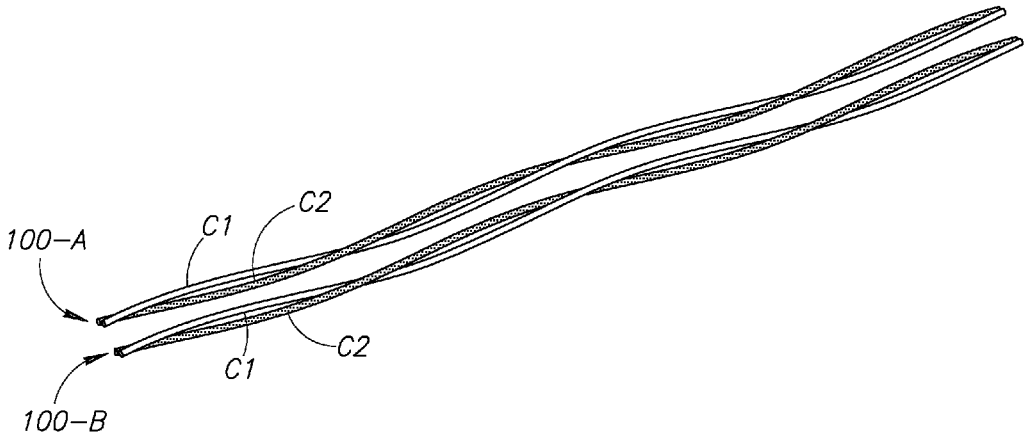
FIG. 7 is a perspective view of a model of a "quasi-pair" of a first cable constructed in accordance with the cable of FIG. 5 and a "quasi-pair" of a second cable constructed in accordance with the cable of FIG. 5.

An electrical simulation was performed using ANSOFT simulation tools. Referring to FIGS. 6 and 7, differential mode coupling between "quasi-pairs" was simulated for (1) adjacent cables 10-A and 10-B each constructed in accordance with the prior art cable 10 illustrated in FIG. 1 (i.e., a conventional cable design) and (2) adjacent cables 100-A and 100-B each constructed in accordance with the cable 100 illustrated in FIG. 5.

As explained above, the twisted pair P4 and the twisted pair P2 together form a "quasi pair" when the cable 100 is connected to hardware using the TIA-568 B wiring format. To simplify the simulation, in each of the cables 10-A, 10-B, 100-A, and 100-B, the two separate wires W-7 and W-8 or conductors of the twisted pair P4 were modeled as a single copper conductor C1 and the two separate wires W-1 and W-2 or conductors of the twisted pair P2 were modeled as a single copper conductor C2. The conductor C1 has a diameter approximately equal to the combined diameter of the two conductors of the twisted pair P4. The conductor C2 has a diameter approximately equal to the combined diameter of the two conductors of the twisted pair P2. For ease of illustration, in FIGS. 6 and 7, the split twisted pair P3 and the flanked twisted pair P1 have been omitted.

Only one complete twist of the "quasi-pair" was used in the simulation. The length of the twist was substantially equal to the cable lay length (i.e., approximately 4 inches).

The two "quasi pairs" of the adjacent cables 10-A and 10-B were modeled side-by-side as they would be positioned within cables positioned alongside one another. Similarly, the two "quasi pairs" of the adjacent cables 100-A and 100-B were also modeled side-by-side as they would be positioned within cables positioned alongside one another. The effective dielectric constant between the two "quasi pairs" of the adjacent cables 10-A and 10-B and between the two "quasi pairs" of the adjacent cables 100-A and 100-B was estimated to be about 2.5.

For a range of simulated frequencies (e.g., about 10 MHz to about 500 MHz), the simulation calculated a minimum amount, a maximum amount, and an average amount of alien crosstalk occurring between (1) the two "quasi pairs" of the cables 10-A and 10-B and (2) the two "quasi pairs" of the cables 100-A and 100-B. To determine these values, the cable 10-A was rotated relative to the cable 10-B a total of 180 degrees in 30 degree increments and the cable 100-A was rotated relative to the cable 100-B a total of 180 degrees in 30 degree increments. After each incremental rotation, the amount alien crosstalk occurring between (1) the two "quasi pairs" of the cables 10-A and 10-B and (2) the two "quasi pairs" of the cables 100-A and 100-B was determined for the simulated frequencies in the range. Then, for each simulated frequency, a minimum amount, a maximum amount, and an average amount of alien crosstalk were determined.

Figure 8:
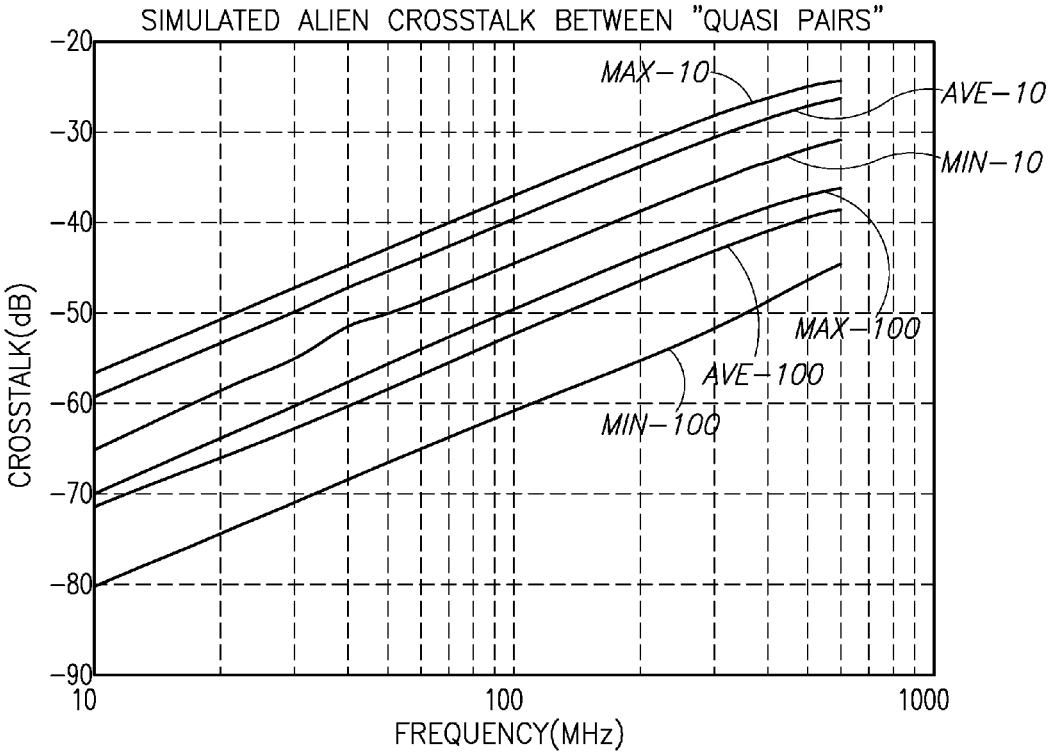
FIG. 8 is a graph of a minimum amount, a maximum amount, and an average amount of alien crosstalk occurring over a range of operating frequencies between the two "quasi pairs" of FIG. 6 and between the two "quasi pairs" of FIG. 7.

FIG. 8 is a graph of the minimum amount, the maximum amount, and the average amount of alien crosstalk occurring between (1) the two "quasi pairs" of the cables 10-A and 10-B and (2) the two "quasi pairs" of the cables 100-A and 100-B over the range of simulated frequencies. In FIG. 8, the x-axis is frequency in megahertz ("MHz") and the y-axis is crosstalk measured in decibels ("dB"). A line "MAX-10" is a plot of the maximum amount of crosstalk occurring between the two "quasi pairs" of the cables 10-A and 10-B at a particular frequency. A line "MIN-10" is a plot of the minimum amount of crosstalk occurring between the two "quasi pairs" of the cables 10-A and 10-B at a particular frequency. A line "AVE-10" is a plot of the average amount of crosstalk occurring between the two "quasi pairs" of the cables 10-A and 10-B at a particular frequency. A line "MAX-100" is a plot of the maximum amount of crosstalk occurring between the two "quasi pairs" of the cables 100-A and 100-B at a particular frequency. A line "MIN-100" is a plot of the minimum amount of crosstalk occurring between the two "quasi pairs" of the cables 100-A and 100-B at a particular frequency. A line "AVE-100" is a plot of the average amount of crosstalk occurring between the two "quasi pairs" of the cables 100-A and 100-B at a particular frequency.

As can be seen in FIG. 8, there is a significant reduction in alien crosstalk between the "quasi pairs" of the cables 100-A and 100-B compared to the alien crosstalk occurring between the "quasi pairs" of the cables 10-A and 10-B. This reduction is about 10 dB to about 12 dB across the range of simulated frequencies.

Experimental Results

Those of ordinary skill in the art appreciate that the alien crosstalk simulated above included only intermediate alien crosstalk that occurs between adjacent cables. Differential mode coupling between "quasi-pairs" is converted into additional alien crosstalk in a communications system that uses typical RJ-45 type hardware, which adds to the total alien crosstalk in the system. To evaluate the effect of the predetermined order of the twisted pairs P1-P4 of the cable 100 on total alien crosstalk, at least a portion of a communications system (such as a channel, which includes additional hardware components) must be considered.

Figure 9:
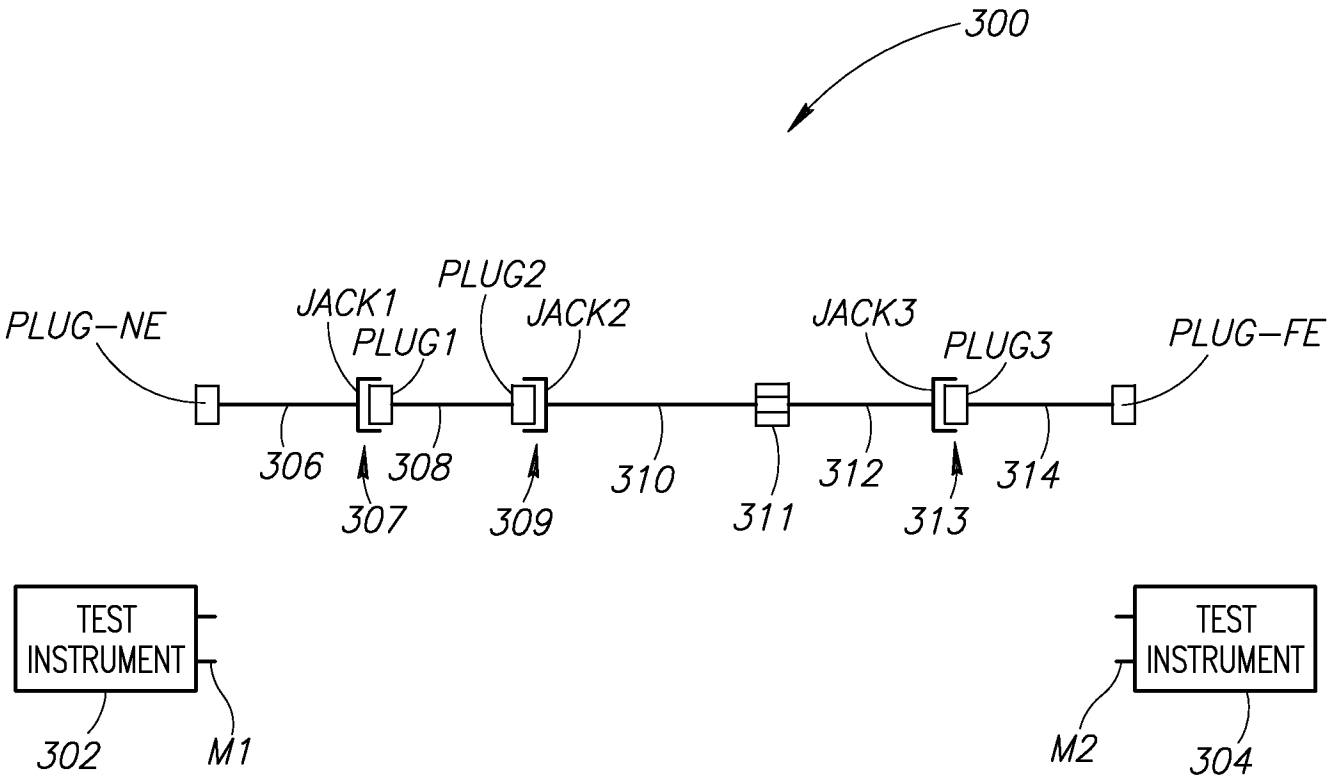
FIG. 9 is an illustration of one of seven channels used for standard 100 meter, four connector channel "6-around-1", alien crosstalk testing as specified in TIA 568 C.2.

FIG. 9 is an illustration of a channel 300, which is one of seven like channels used for standard 100 meter, four connector channel "6-around-1", alien crosstalk testing as specified in TIA 568 C.2. Corresponding components from the seven channels are located in close proximity to each other as dictated by the physical design of the components and the TIA 568 C.2 specification. A centrally located channel is designated as a "disturbed" channel and the remaining, surrounding six channels are designated a "disturbers." Signals are sent along the "disturber" channels and crosstalk measured in the centrally located "disturbed" channel. This is the standard channel arrangement used to determine power sum alien near-end crosstalk ("PSANEXT") and power sum alien attenuation to crosstalk ratio-far end ("PSAACR-F") values.

FIG. 9 also illustrates a first instrument 302 and a second instrument 304. The first and second instruments 302 and 304 each have an RJ-45 type measurement ports M1 and M2, respectively, that functions as a measurement port.

Each of the seven channels (e.g., the channel 300) has a near-end plug "PLUG-NE" opposite a far-end plug "PLUG-FE." The near-end plugs "PLUG-NE" and the far-end plugs "PLUG-FE" may be selectively coupled one at a time to the measurement ports M1 and M2 of the first and second instruments 302 and 304, respectively. The first and second test instruments 302 and 304 are connectable to either the near-end plug "PLUG-NE" or the far-end plug "PLUG-FE" of one of the seven channels under test as dictated by the TIA 568

C.2 specification. Tests are conducted by selectively connecting the measurement port M1 of the first instrument 302 to the near-end plug "PLUG-NE" of one of the seven channels, and the measurement port M2 of the second instrument 304 to either the near-end plug "PLUG-NE" or the far-end plug "PLUG-FE" of a different one of the seven channels. These connections are formed as prescribed by the TIA 568 C.2 industry standard.

The connections formed between the first and second test instruments 302 and 304 and the channels are not considered part of the four connector channel under test. The electrical effects of the connections formed between the first and second test instruments 302 and 304 and the channels are taken into account by the specification and/or negated by the first and second test instruments 302 and 304.

In FIG. 9, with respect to the channel 300, a first connection 307 is formed by an outlet or jack "JACK1" and a plug "PLUG1." A second connection 309 is formed by an outlet or jack "JACK2" and a plug "PLUG2." A third connection 311 is formed by a simple punch down block. This location in the channel 300 is referred to as a "consolidation point" or CP. A forth connection 313 is formed by an outlet or jack "JACK3" and a plug "PLUG3."

The channel 300 includes a first patch cord 306. The first patch cord 306 is terminated with the plug "PLUG-NE." The plug "PLUG-NE" is connectable to the measurement port M1 of the first test instrument 302, or to the measurement port M2 of the second test instrument 304, as dictated by the measurement and channel/pair combination being tested. The first patch cord 306 is punched down to insulation displacement contacts (not shown) of the jack "JACK1." The first patch cord 306 has a length of about three meters.

The channel 300 includes a second patch cord 308. A near end of the second patch cord 308 is terminated with the plug "PLUG1" which is connected to the jack "JACK1." A far end of the second patch cord 308 is connected to the plug "PLUG2." The plug "PLUG2" is connected to the jack "JACK2." The second patch cord 308 has a length of about two meters.

The channel 300 includes a first section of horizontal cable 310. A near end of the first section of horizontal cable 310 is punched down to the insulation displacement contacts (not shown) of the jack "JACK2." A far end of the first section of horizontal cable 310 is punched down to the third connection 311 (the punch down block). The first horizontal cable 310 has a length of about eighty-five meters.

The channel 300 includes a second section of horizontal cable 312. A near end of the second section of horizontal cable 312 is punched down to the third connection 311, which is a consolidation point. A far end of the second section of horizontal cable 312 is punched down to the insulation displacement contacts (not shown) of the jack "JACK3." The second horizontal cable 310 has a length of about five meters.

The channel 300 includes a third patch cord 314. A near end of the third patch cord 314 is terminated with the plug "PLUG3." The plug "PLUG3" is connected to the jack "JACK3." A far end of the third patch cord 314 is connected to the plug "PLUG-FE." The plug "PLUG-FE" is connectable to the measurement port M2 of the test instrument 304 when dictated by the measurement and channel/pair combination being tested. The third patch cord 314 has a length of about five meters.

Figure 3:
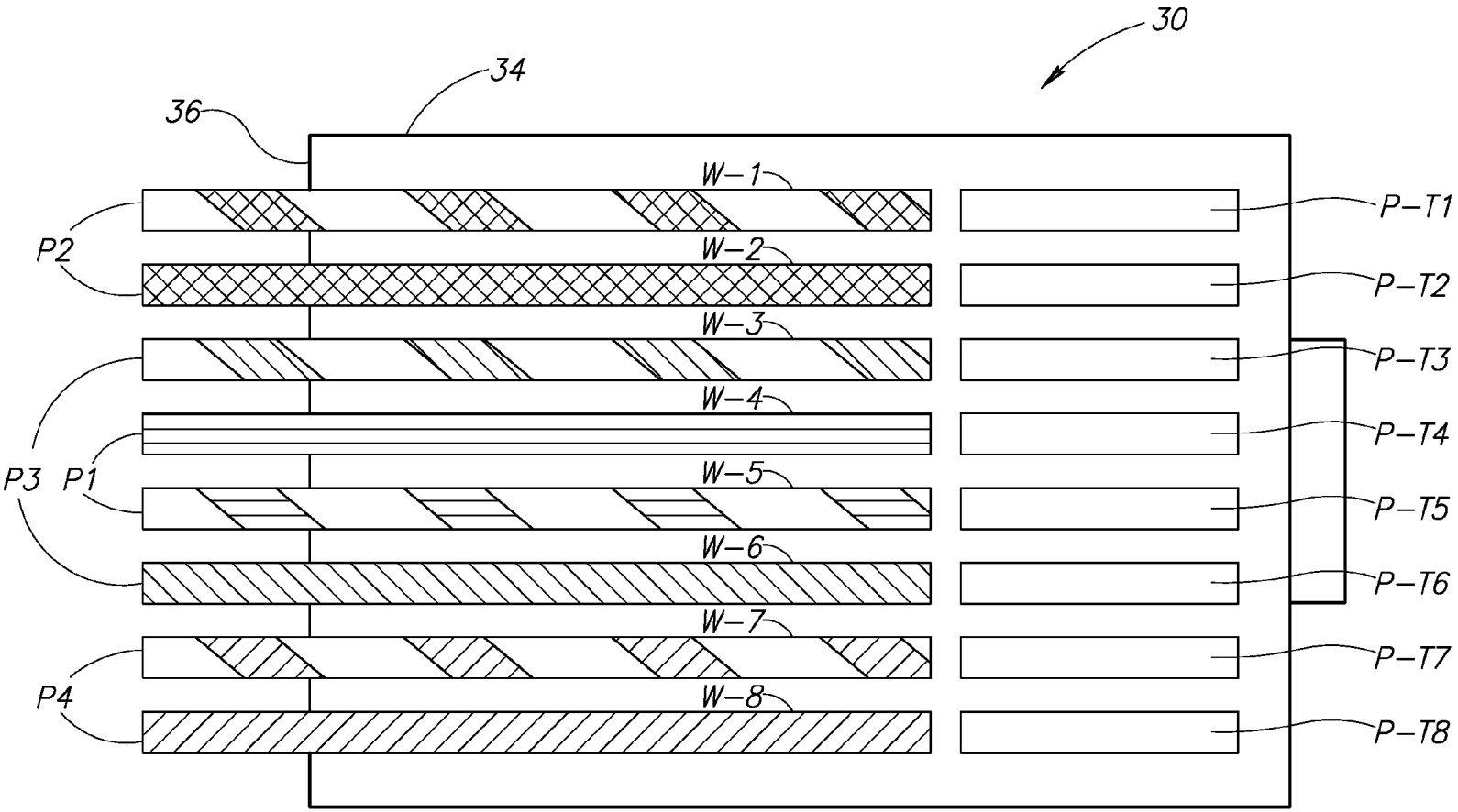
FIG.3 (PRIOR ART)
FIG. 3 is a schematic of a conventional plug constructed according to TIA-568 B wiring format.
Figure 4:
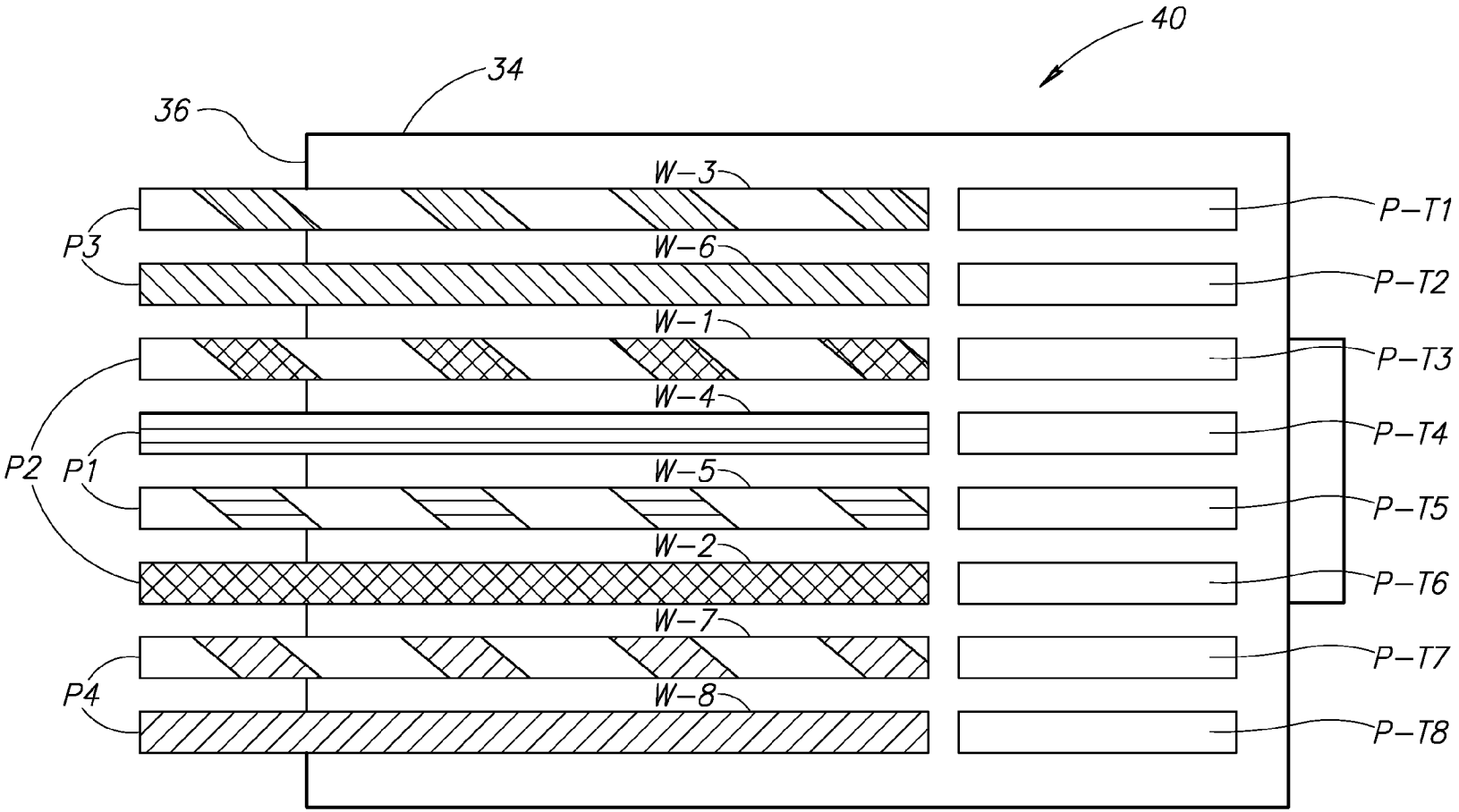
FIG. 4 (PRIOR ART)
FIG. 4 is a schematic of a conventional plug constructed according to TIA-568 A wiring format.

As is apparent to those of ordinary skill in the art, patch cords (typically made using stranded conductors) are usually connected to RJ-45 plugs (e.g., the plug 30 illustrated in FIG. 3, the plug 40 illustrated in FIG. 4, and the like). On the other hand, horizontal cables (typically made using solid insulated conductors) are not usually terminated to plugs. For example, a horizontal cable may be connected to a cross connect (e.g., the cross connect block 311). As illustrated in FIG. 9, patch cords and horizontal cables may also be terminated by RJ-45 outlets or jacks.

The patch cords 306, 308, and 314 of each of the seven channels were constructed using conventional patch cordage constructed similar to the cable 10 illustrated in FIG. 1. The patch cords 306, 308, and 314 were terminated to hardware using the TIA-568 B wiring format and remained wired in this manner throughout the testing. The horizontal cables 310 and 312 were also using conventional horizontal type cable constructed in accordance with the cable 10 illustrated in FIG. 1.

Initially, all of the cables and connectors of the seven channels were terminated as described above. Alien near-end crosstalk ("ANEXT") and alien attenuation to crosstalk ratio-far end ("AACR-F") were measured and PSANEXT and PSAACR-F were calculated and recorded.

Next, the wiring at the near end of the first horizontal cable 310 and the far end of the second horizontal cable 312 in each of the seven channels was modified where the horizontal cables 310 and 312 connect to the jacks "JACK2" and "JACK3," respectively. Specifically, at the jack "JACK2," the positions of twisted pairs P3 and P4 in the first horizontal cable 310 where interchanged at the insulation displacement contacts (not shown) of the jack "JACK2." Similarly, at the jack "JACK3," the positions of twisted pairs P3 and P4 in the second horizontal cable 312 where interchanged at the insulation displacement contacts (not shown) of the jack "JACK3." These interchanges were done to replicate or approximate the construction of the cable 100. By approximating the structure of the cable 100 in this manner, the same cable/cable bundles used in the initial testing were also used for subsequent testing thereby insuring the inherent electrical performance of the cables and connectors remained the same throughout the testing. Therefore, any change observed in alien crosstalk performance would be a result of the rearrangement of the positions of the twisted pairs P3 and P4 in the seven channels and not any change in inherent performance of the cables or connectors.

The wiring of the third connection 311 forming the consolidation point was not changed. The third connection 311 uses a simple method of wiring where the twisted pairs P1-P4 are "piggy backed" on top of each other. Unlike in RJ-45 jacks and plugs, the third connection 311 does not include split pairs and the pairs are spaced apart by a significant distance from one another so as to reduce the influence of any one pair to the other remaining pairs. Therefore, modal alien crosstalk is not considered a factor in the electrical performance of the third connection 311. Electrical results validate this premise. Therefore, the wiring of the third connection 311 can remain the same throughout testing without effecting the results.

ANEXT and AACR-F of the modified channel configuration were measured and PSANEXT and PSAACR-F were calculated and recorded for the modified channel configuration.

Table A below lists margins between the Augmented Category 6 specifications for PSANEXT and the PSANEXT values measured for both the initial configuration of the channel 300 and the modified configuration of the channel 300. Table B below lists margins between the Augmented Category 6 specifications for the PSAACR-F and the PSAACR-F values measured for both the initial configuration of the channel 300 and the modified configuration of the channel 300. As may be seen in Tables A and B, the worst case PSANEXT and PSAACR-F values improved in the modified configuration compared to the initial configuration. Specifically, in Tables A and B, the worst case PSANEXT value improved by about 1.3 dB, and the worse case PSAACR-F value improved by about 3.8 dB.

TABLE A

| Twisted Pairs | PSANEXT MARGIN (dB) Initial Configuration of the channel 300 | Modified Configuration of the channel 300 | Difference (dB) |
|---|---|---|---|
| P1 | 8.2 | 7.7 | −0.5 |
| P2 | 3.1 | 8.5 | 5.4 |
| P3 | 1.0 | 2.3 | 1.3 |
| P4 | 8.0 | 7.6 | −0.4 |
| Average | 5.7 | 6.2 | +0.5 |
| Worst Case | 1.0 | 2.3 | +1.3 |

TABLE B

| Twisted Pairs | PSAACR-F MARGIN (dB) Initial Configuration of the channel 300 | Modified Configuration of the channel 300 | Difference (dB) |
|---|---|---|---|
| P1 | 5.8 | 6.8 | 1.0 |
| P2 | 9.0 | 9.6 | 0.6 |
| P3 | 0.1 | 3.9 | 3.8 |
| P4 | 10.0 | 7.3 | −2.7 |
| Average | 3.8 | 3 | −0.8 |
| Worst Case | 0.1 | 3.9 | +3.8 |

Figure 10:
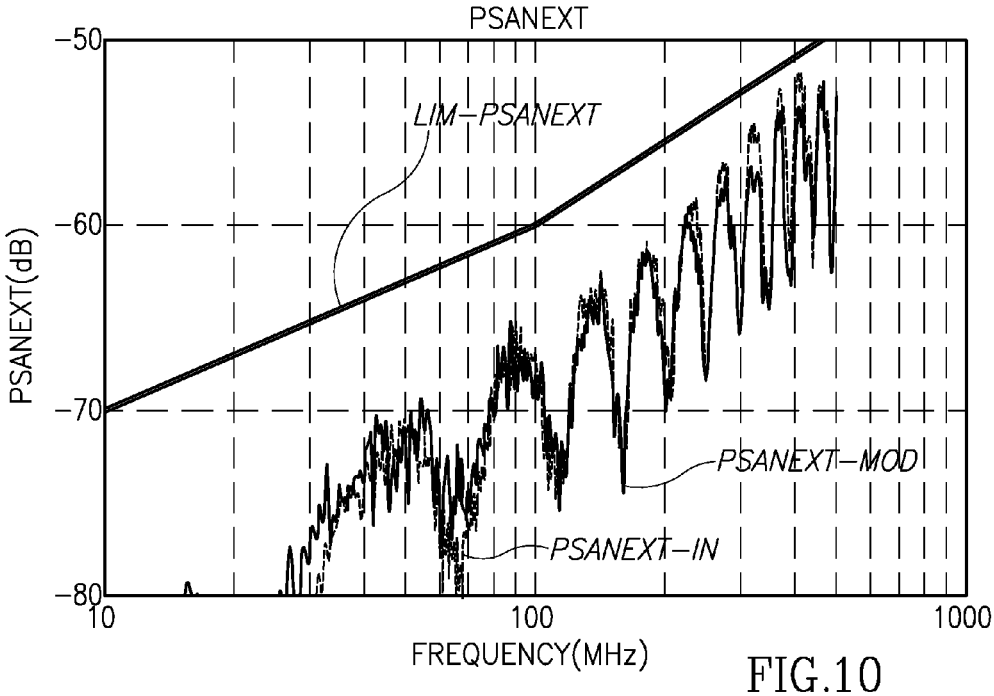
FIG. 10 is a graph of PSANEXT measured over an operating frequency range for an initial configuration and a modified configuration of the channel of FIG. 9.

FIG. 10 is a graph of PSANEXT (measured in dB) measured in the third twisted pairs P3 of the "disturbed" channel of the channel 300 over an operating frequency range (measured in MHz) from about 10 MHz to about 500 MHz. As described above, the wires W3 and W6 of the third twisted pair P3 are connected to the plug contacts P-T3 and P-T6, respectively. Thus, the third twisted pair P3 has the largest component of modal alien crosstalk.

In FIG. 10, a double line "LIM-PSANEXT" illustrates a PSANEXT limit for each frequency in the operating frequency range. A dashed line "PSANEXT-IN" is a plot of PSANEXT measured in the third twisted pairs P3 of the "disturbed" channel in the initial configuration of the channel 300. A solid line "PSANEXT-MOD" is a plot of PSANEXT measured in the third twisted pairs P3 of the "disturbed" channel in the modified configuration of the channel 300.

Figure 11:
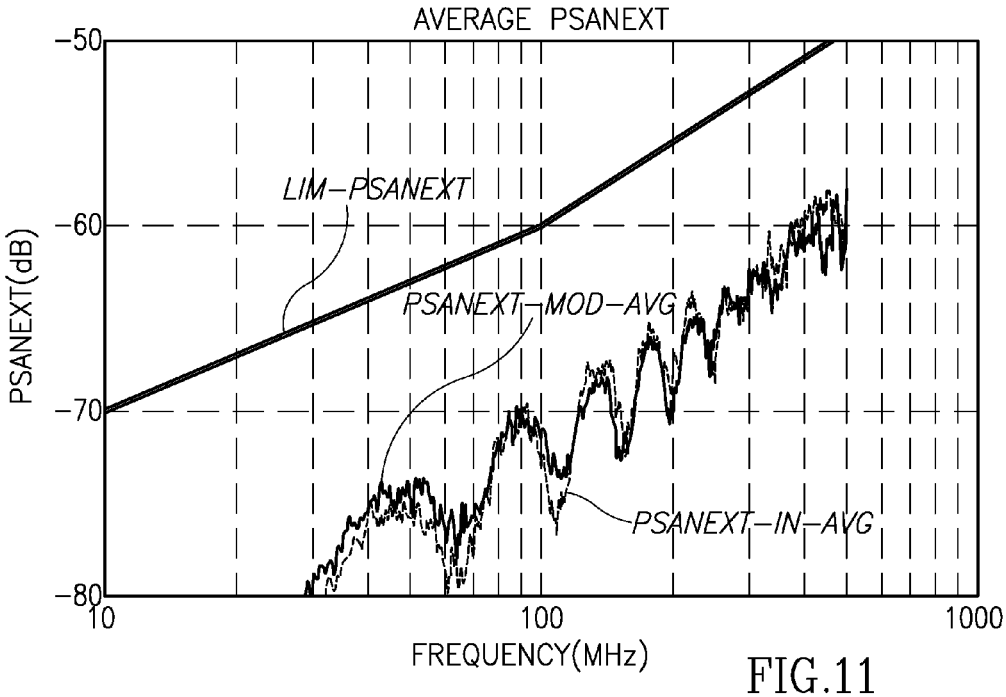
FIG. 11 is a graph of average PSANEXT measured over an operating frequency range for the initial configuration and the modified configuration of the channel of FIG. 9.

FIG. 11 is a graph of average PSANEXT (measured in dB) over the operating frequency range (measured in MHz). A dashed line "PSANEXT-IN-AVG" is a plot of the average PSANEXT measured in the third twisted pairs P3 of the "disturbed" channels in the initial configuration of the channel 300. A solid line "PSANEXT-MOD-AVG" is a plot of the average PSANEXT measured in the third twisted pairs P3 of the "disturbed" channels in the modified configuration of the channel 300.

Figure 12:
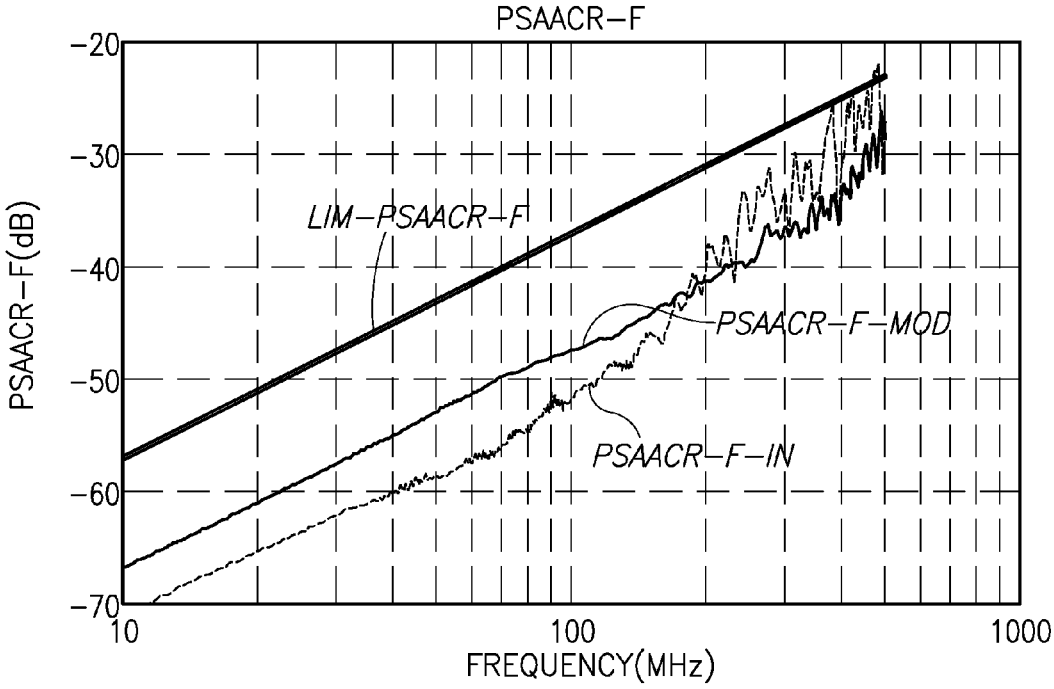
FIG. 12 is a graph of PSAACR-F measured over an operating frequency range for the initial configuration and the modified configuration of the channel of FIG. 9.

FIG. 12 is a graph of PSAACR-F (measured in dB) measured in the third twisted pairs P3 of the "disturbed" channel of the channel 300 over the operating frequency range (measured in MHz) from about 10 MHz to about 500 MHz. In FIG. 12, a double line "LIM-PSAACR-F" illustrates a PSAACR-F limit for each frequency in the operating frequency range. A dashed line "PSAACR-F-IN" is a plot of PSAACR-F measured in the third twisted pairs P3 of the "disturbed"-channel in the initial configuration of the channel 300. A solid line "PSAACR-F-MOD" is a plot of PSAACR-F measured in the third twisted pairs P3 of the "disturbed" channel in the modified configuration of the channel 300.

Figure 13:
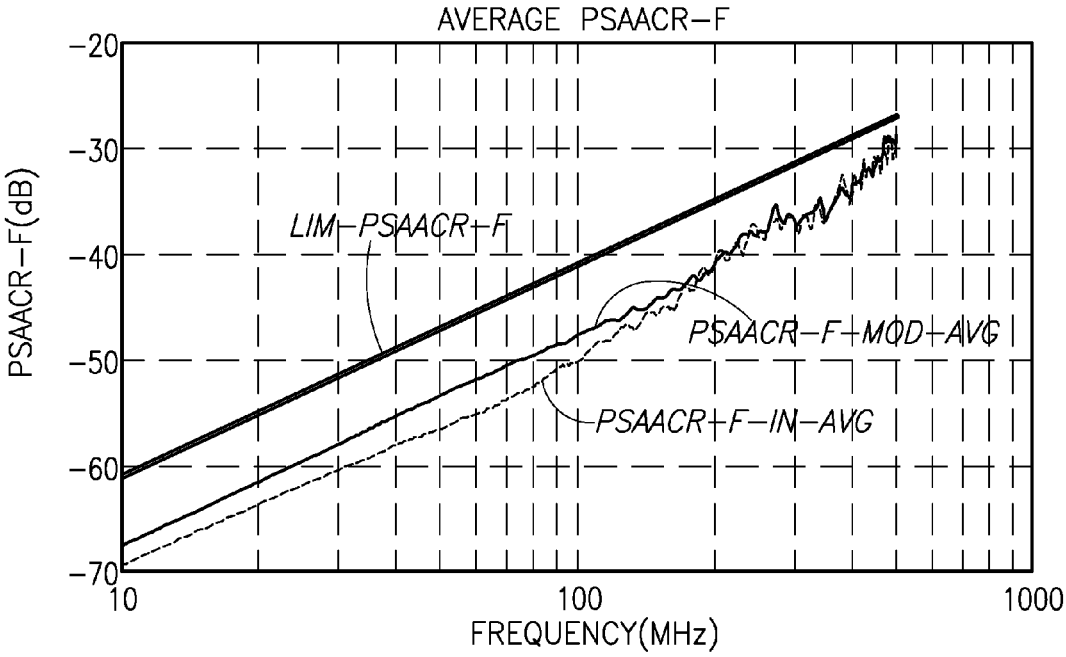
FIG. 13 is a graph of average PSAACR-F measured over an operating frequency range for the initial configuration and the modified configuration of the channel of FIG. 9.

FIG. 13 is a graph of average PSAACR-F (measured in dB) over an operating frequency range (measured in MHz). A dashed line "PSAACR-F-IN-AVG" is a plot of the average PSAACR-F measured in the third twisted pairs P3 of the "disturbed" channel in the initial configuration of the channel 300. A solid line "PSAACR-F-MOD-AVG" is a plot of the average PSAACR-F measured in the third twisted pairs P3 of the "disturbed" channel in the modified configuration of the channel 300.

Referring to FIG. 12, the most dramatic improvement in PSAACR-F begins at about 180 MHz and continues until about 500 MHz, which was the highest frequency measured. Referring to FIG. 10, there is a less dramatic improvement in PSANEXT; however, improvement clearly does occur in the third twisted pairs P3, particularly at higher frequencies.

It should be noted that in the example shown here, only the twisted pairs P3 and P4 in the horizontal cables 310 and 312 (shown in FIG. 9) of the seven channels were exchanged. If the positions of the twisted pairs P3 and P4 in the patch cords 306, 308 and 314 also been exchanged, the overall improvement in alien crosstalk performance may have been better. However, this may depend on inherent aspects of the construction and performance of the patch cords.

The cable 100 is configured for use with a communications connector having a plurality of connections, such as a plurality of contacts arranged in a series like the plug contacts P-T1 to P-T8. Non-limiting examples of suitable communications connectors for use with the cable 100 include a conventional RJ-45 plug (e.g., the plug 30 illustrated in FIG. 3 or the RJ-45 plug 40 illustrated in FIG. 4), a conventional RJ-45 outlet (e.g., jack "JACK1" illustrated in FIG. 9), a cross connect (e.g., the cross connect block 311 illustrated in FIG. 9), and the like.

While the predetermined order of the twisted pairs P1-P4 of the cable 100 has been described for use with Category 6 and Category 6A cables, those of ordinary skill in the art appreciate that the predetermined orders of the twisted pairs P1-P4 may be used in other types of network cable, Ethernet cable, and the like. By way of non-limiting examples, the predetermined orders of the twisted pairs P1-P4 of the cable 100 may be used to construct cables of other Categories, such as Category 5 cables, Category 5e cables, Category 6A cables, Category 7 cables, Category 7A cables, and the like.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A communications cable for use with a communications connector comprising a plurality of serially arranged contacts, the contacts comprising a first contact in the series, a second contact in the series, a third contact in the series, a fourth contact in the series, a fifth contact in the series, a sixth contact in the series, a seventh contact in the series, and an eighth contact in the series, the communications cable comprising:

a first wire configured to be connected to the first contact;

a second wire configured to be connected to the second contact, a third wire configured to be connected to the third contact;

a fourth wire configured to be connected to the fourth contact, a fifth wire configured to be connected to the fifth contact;

a sixth wire configured to be connected to the sixth contact;

a seventh wire configured to be connected to the seventh contact; and an eighth wire configured to be connected to the eighth contact;

the fourth and fifth wires being twisted together to form a first twisted wire pair, the first and second wires being twisted together to form a second twisted wire pair, the third and sixth wires being twisted together to form a third twisted wire pair, the seventh and eighth wires being twisted together to form a fourth twisted wire pair, the first, second, third, and fourth twisted wire pairs being arranged such that the first twisted wire pair is closer to the second and third twisted wire pairs than the first twisted wire pair is to the fourth twisted wire pair, and the second twisted wire pair is closer to the first and fourth twisted wire pairs than the second twisted wire pair is to the third twisted wire pair, the communications cable being constructed according to a Category 6A standard, a Category 7 standard, or a Category 7A standard.

2. The communications cable of claim 1, further comprising a central portion wherein the first, second, third, and fourth twisted wire pairs are positioned alongside one another about the central portion;

the first twisted wire pair is positioned between the second and third twisted wire pairs and across the central portion from the fourth twisted wire pair; and the second twisted wire pair is positioned between the first and fourth twisted wire pairs and across the central portion from the third twisted wire pair.

3. The communications cable of claim 1, wherein the first, second, third, and fourth twisted wire pairs are twisted together.

4. The communications cable of claim 1, further comprising:

a separator interposed between the first, second, third, and fourth twisted wire pairs.

5. The communications cable of claim 4, wherein the separator comprises:

a first dividing wall extending between the first and second twisted wire pairs and separating them from one another;

a second dividing wall extending between the second and fourth twisted wire pairs and separating them from one another;

a third dividing wall extending between the fourth and third twisted wire pairs and separating them from one another; and a fourth dividing wall extending between the third and first twisted wire pairs and separating them from one another.

6. The communications cable of claim 5, further comprising:

an outer insulating layer defining an interior, the separator being positioned inside the interior defined by the outer insulating layer, the first, second, third, and fourth dividing walls of the separator dividing the interior into four substantially equally sized quadrants.

7. A communications cable for use with a communications connector comprising a first pair of contacts, a second pair of contacts, a third pair of contacts, and a fourth pair of contacts, the third pair of contacts comprising a first contact spaced apart from a second contact, the first pair of contacts being positioned between the first contact and the second contact of the third pair of contacts, the second pair of contacts being adjacent the first contact of the third pair of contacts, and the fourth pair of contacts being adjacent the second contact of the third pair of contacts, the communications cable comprising:

a first pair of wires twisted together and configured to be connected to the first pair of contacts to form a first differential signaling pair;

a second pair of wires twisted together and configured to be connected to the second pair of contacts to form a second differential signaling pair;

a third pair of wires comprising a first wire twisted together with a second wire, the first wire being configured to be connected to the first contact of the third pair of contacts, and the second wire being configured to be connected to the second contact of the third pair of contacts to form a third differential signaling pair, when the second pair of wires is connected to the second pair of contacts and the third pair of wires is connected to the third pair of contacts, the second pair of wires forming a first composite conductor receiving a first crosstalk signal from the first contact and the first wire of the third pair of wires connected thereto; and a fourth pair of wires twisted together and configured to be connected to the fourth pair of contacts to form a fourth differential signaling pair, when the fourth pair of wires is connected to the fourth pair of contacts and the third pair of wires is connected to the third pair of contacts, the fourth pair of wires forming a second composite conductor receiving a second crosstalk signal from the second contact and the second wire of the third pair of wires connected thereto, the first, second, third, and fourth pairs of wires being positioned alongside one another with the second pair of wires being closer to the fourth pair of wires than the second pair of wires is to the third pair of wires to limit an amount of the first crosstalk signal received by the first composite conductor and an amount of the second crosstalk signal received by the second composite conductor, the communications cable being a Category 6A cable, a Category 7 cable, or a Category 7A cable.

8. The communications cable of claim 7, wherein the first, second, third, and fourth pairs of wires are twisted together.

9. A communications cable for use with a communications connector comprising a first pair of contacts, a second pair of contacts, a third pair of contacts, and a fourth pair of contacts, the third pair of contacts comprising a first contact spaced apart from a second contact, the first pair of contacts being positioned between the first and second contacts of the third pair of contacts, the second pair of contacts being adjacent the first contact of the third pair of contacts, and the fourth pair of contacts being adjacent the second contact of the third pair of contacts, the communications cable comprising:

a first pair of wires twisted together and configured to be connected to the first pair of contacts;

a second pair of wires twisted together and configured to be connected to the second pair of contacts;

a third pair of wires twisted together and configured to be connected to the third pair of contacts; and a fourth pair of wires twisted together and configured to be connected to the fourth pair of contacts, the first, second, third, and fourth pairs of wires being twisted together to form a bundle, within the bundle, the first pair of wires being adjacent both the second and third pairs of wires and across from the fourth pair of wires, and within the bundle, the second pair of wires being adjacent both the first and fourth pairs of wires and across from the third pair of wires, wherein the communications cable is a Category 6A cable, a Category 7 cable, or a Category 7A cable.

10. The communications cable of claim 9, further comprising:

a separator interposed between the first, second, third, and fourth pairs of wires, the separator comprising:

a first dividing wall extending between the first and second pairs of wires and separating them from one another;

a second dividing wall extending between the second and fourth pairs of wires and separating them from one another;

a third dividing wall extending between the fourth and third pairs of wires and separating them from one another; and a fourth dividing wall extending between the third and first pairs of wires and separating them from one another.

11. A communications cable comprising:

a communications connector comprising a plurality of serially arranged contacts, the contacts comprising a first contact in the serial arrangement, a second contact in the serial arrangement, a third contact in the serial arrangement, a fourth contact in the serial arrangement, a fifth contact in the serial arrangement, a sixth contact in the serial arrangement, a seventh contact in the serial arrangement, and an eighth contact in the serial arrangement; and a cable segment configured to mitigate alien crosstalk, the cable segment comprising:

a first wire having a first end portion connected to the first contact, and a second end portion extending away from the first end portion;

a second wire having a first end portion connected to the second contact, and a second end portion extending away from the first end portion;

a third wire having a first end portion connected to the third contact, and a second end portion extending away from the first end portion;

a fourth wire having a first end portion connected to the fourth contact, and a second end portion extending away from the first end portion;

a fifth wire having a first end portion connected to the fifth contact, and a second end portion extending away from the first end portion;

a sixth wire having a first end portion connected to the sixth contact, and a second end portion extending away from the first end portion;

a seventh wire having a first end portion connected to the seventh contact, and a second end portion extending away from the first end portion;

an eighth wire having a first end portion connected to the eighth contact, and a second end portion extending away from the first end portion, the second end portions of the fourth and fifth wires being twisted together to form a first twisted wire pair, the second end portions of the first and second wires being twisted together to form a second twisted wire pair, the second end portions of the third and sixth wires being twisted together to form a third twisted wire pair, the second end portions of the seventh and eighth wires being twisted together to form a fourth twisted wire pair; and an outer insulating layer, the first, second, third, and fourth twisted wire pairs being arranged alongside one another and surrounded by the outer insulating layer, inside the outer insulating layer, the first twisted wire pair being closer to both the second and third twisted wire pairs than the first twisted wire pair is to the fourth twisted wire pair, and the second twisted wire pair being closer to both the first and fourth twisted wire pairs than the second twisted wire pair is to the third twisted wire pair.

12. The communications cable of claim 11, wherein the communications connector is a plug or an outlet.

13. The communications cable of claim 11, wherein the communications connector is a RJ-45 type-plug wired according to TIA-568 B wiring format.

14. The communications cable of claim 11, wherein the communications connector is a RJ-45 type-plug wired according to TIA-568 A wiring format.

15. The communications cable of claim 11, wherein the cable segment further comprises:

a separator interposed between the first, second, third, and fourth twisted wire pairs, the separator comprising:

a first dividing wall extending between the first and second twisted wire pairs to separate them from one another;

a second dividing wall extending between the second and fourth twisted wire pairs to separate them from one another;

a third dividing wall extending between the fourth and third twisted wire pairs to separate them from one another; and a fourth dividing wall extending between the third and first twisted wire pairs to separate them from one another.

16. The communications cable of claim 11, wherein the first, second, third, and fourth twisted wire pairs are twisted together inside the outer insulating layer.

17. A communications cable for use with a communications connector, the communications cable comprising:

a longitudinal dimension;

an outer insulating layer defining a longitudinally extending channel;

a separator dividing the channel into four longitudinally extending chambers comprising a first chamber, a second chamber, a third chamber, and a fourth chamber, the second chamber being positioned between the first and third chambers, the third chamber being positioned between the second and fourth chambers, and the fourth chamber being positioned between the third and first chambers;

a flanked pair of twisted wires extending longitudinally within the first chamber;

a first outside pair of twisted wires extending longitudinally within the second chamber;

a second outside pair of twisted wires extending longitudinally within the third chamber; and a split pair of twisted wires extending longitudinally within the fourth chamber, the split pair of twisted wires comprising a first wire twisted together with a second wire, the first and second wires being configured to be untwisted and split apart to flank the flanked pair of twisted wires inside the communications connector, when so split apart, inside the communications connector, the first wire being positionable adjacent to the first outside pair of twisted wires, and the second wire being positionable adjacent to the second outside pair of twisted wires, wherein the communications cable satisfies alien crosstalk performance requirements specified in a Category 6A standard, a Category 7 standard, or a Category 7A standard.

18. The communications cable of claim 17, wherein the separator, the flanked pair of twisted wires, the first outside pair of twisted wires, the second outside pair of twisted wires, and the split pair of twisted wires are twisted together as a unit inside the outer insulating layer.

19. A communications cable for use with a communications connector comprising a first pair of contacts, a second pair of contacts, a third pair of contacts, and a fourth pair of contacts, the third pair of contacts comprising a first contact spaced apart from a second contact, the first pair of contacts being positioned between the first contact and the second contact of the third pair of contacts, the second pair of contacts being adjacent the first contact of the third pair of contacts, and the fourth pair of contacts being adjacent the second contact of the third pair of contacts, the communications cable comprising:

a central portion;

a first pair of wires twisted together and configured to be untwisted to be connected to the first pair of contacts;

a second pair of wires twisted together and configured to be untwisted to be connected to the second pair of contacts;

a third pair of wires twisted together and configured to be untwisted to be connected to the third pair of contacts; and a fourth pair of wires twisted together and configured to be untwisted to be connected to the fourth pair of contacts, the first, second, third, and fourth pairs of wires being positioned alongside one another about the central portion with the first pair of wires positioned across the central portion from the fourth pair of wires and the second pair of wires positioned across the central portion from the third pair of wires, wherein the communications cable is configured to satisfy alien crosstalk performance requirements specified in a Category 6A standard, a Category 7 standard, or a Category 7A standard.

20. A communications cable comprising:

a first composite wire comprising a first wire and a second wire;

a second composite wire comprising a third wire and a fourth wire, together the first and second composite wires forming a quasi differential signaling pair; and a differential signaling pair comprising a fifth wire and a sixth wire, the fifth and sixth wires being spaced apart from one another along an end portion of the differential signaling pair, a portion of the first composite wire being adjacent the fifth wire at the end portion of the differential signaling pair, the fifth wire inducing a first signal having a first signal strength in the portion of the first composite wire adjacent thereto, a portion of the second composite wire being adjacent the sixth wire at the end portion of the differential signaling pair, the sixth wire inducing a second signal having a second signal strength in the portion of the second composite wire adjacent thereto, the first composite wire, the second composite wire, and the differential signaling pair being positioned alongside and adjacent one another without the differential signaling pair being interposed therebetween to limit the first and second signal strengths of the first and second signals, respectively, wherein the communications cable is configured to satisfy alien crosstalk performance requirements specified in a Category 6A standard, a Category 7 standard, or a Category 7A standard.

21. A method of constructing a communications cable, the method comprising:

forming a differential signaling pair by twisting a portion of a fifth wire and a sixth wire together;

spacing the fifth and sixth wires apart from one another along an end portion of the differential signaling pair;

forming a first composite wire by twisting a first wire and a second wire together;

positioning a portion of the first composite wire adjacent the fifth wire at the end portion of the differential signaling pair such that the fifth wire will induce a first signal having a first signal strength in the portion of the first composite wire adjacent thereto;

forming a second composite wire by twisting a third wire and a fourth wire together;

positioning a portion of the second composite wire adjacent the sixth wire at the end portion of the differential signaling pair such that the sixth wire will induce a second signal having a second signal strength in the portion of the second composite wire adjacent thereto;

positioning the first composite wire and the second composite wire to form a quasi differential signaling pair with the first composite wire, the second composite wire, and the differential signaling pair being positioned alongside and adjacent one another without the differential signaling pair being interposed therebetween to limit the first and second signal strengths of the first and second signals, respectively; and confirming the communications cable satisfies a predetermined alien crosstalk performance requirement.

22. The method of claim 21, wherein the predetermined alien crosstalk performance requirement is defined by at least one of a Category 6A standard, a Category 7 standard, and a Category 7A standard.

* * * * *